US007559220B2

(12) United States Patent
Bordignon et al.

(10) Patent No.: US 7,559,220 B2
(45) Date of Patent: Jul. 14, 2009

(54) BAR SPEED CHANGING DEVICE

(75) Inventors: Giuseppe Bordignon, Bicinicco (IT); Ivan Paiaro, Ronchi dei Legionari (IT); Andrea De Luca, Remanzacco (IT); Alfredo Poloni, Fogliano Redipuglia (IT)

(73) Assignee: Danieli & C. Officine Meccanicite S.p.A., Buitrio (IT)

( * ) Notice: Subject to any disclaimer, the term of this patent is extended or adjusted under 35 U.S.C. 154(b) by 0 days.

(21) Appl. No.: 11/629,452

(22) PCT Filed: Jun. 16, 2005

(86) PCT No.: PCT/EP2005/052779

§ 371 (c)(1),
(2), (4) Date: Dec. 13, 2006

(87) PCT Pub. No.: WO2005/123293

PCT Pub. Date: Dec. 29, 2005

(65) Prior Publication Data

US 2007/0277576 A1 Dec. 6, 2007

(30) Foreign Application Priority Data

Jun. 16, 2004 (IT) ..... MI2004A1209

(51) Int. Cl.
*B21B 39/08* (2006.01)
*B65H 20/02* (2006.01)

(52) U.S. Cl. ..... 72/250; 72/251; 226/177; 226/187

(58) Field of Classification Search ..... 72/250, 72/251, 226, 10.3; 198/608, 623, 624; 226/176, 226/177, 181, 186, 187
See application file for complete search history.

(56) References Cited

U.S. PATENT DOCUMENTS 3,845,708 A * 11/1974 Liebert ..... 100/155 R
6,920,772 B1 * 7/2005 Shore et al. ..... 72/12.5

FOREIGN PATENT DOCUMENTS

| | | |
|---|---|---|
| DE | 4227982 | 5/1993 |
| EP | 0470436 | 2/1992 |
| FR | 2389436 | 12/1978 |
| GB | 2101016 | 3/1982 |
| GB | 2118875 | 11/1983 |
| GB | 2118875 A * | 11/1983 |

* cited by examiner

*Primary Examiner*—Dana Ross
*Assistant Examiner*—Debra M Sullivan
(74) *Attorney, Agent, or Firm*—Stetina Brunda Garred & Brucker

(57) ABSTRACT

A bar speed changing device (48) comprising a pair of upper rollers (55, 55') and a pair of lower rollers (59, 59'). Said device receives a bar section with the rollers (55, 55', 59, 59') in the open position and rotating at a given speed. Upon leaving the device (48) said sections are fed into axially arranged peripheral seats (58) of rotating drum channels. Control devices calculate the speed at which the bar section must be released, upon completion of the braking action, according to the position that said section must occupy in one of said seats and on the basis of the bar-seat friction coefficient. When the rollers (55, 55', 59, 59') receive the bar, they turn at the calculated release speed. At a predefined moment, such to enable braking in the correct space and time, the four rollers close on the section and exert the braking action, exploiting the dynamic friction between the roller-section.

11 Claims, 12 Drawing Sheets

BAR SPEED CHANGING DEVICE

FIELD OF THE INVENTION

This invention relates to a bar speed changing device that can be used, for example, to change the speed of bars leaving a rolling mill.

BACKGROUND OF THE INVENTION

A number of bar speed changing devices, more commonly referred to as bar braking devices, are known in the prior art. Said devices reduce the speed at which bars, that may have different cross-sections, are delivered. Said bars are rolled before being cut and packed.

The bar braking devices known in the prior art that are currently used operate as follows.

The bar braking device waits to receive the bar with the rollers open and rotating with a peripheral speed that is the same as the speed at which the bar is delivered. At a predefined moment, such to enable braking in the correct space and time, the rollers close on the bar and exert the braking action, exploiting the static friction between the roller-bar, since the peripheral speed of the roller is the same as the speed at which the bar is delivered. During braking a motor reduces the speed of the bar and the rollers until the speed of the bar and of the rollers is the same as the speed at which the bar is unloaded. Upon completion of braking, the bar braking device opens and accelerates the rollers until these rotate at the correct speed to receive the bar.

The disadvantage of said bar braking devices is that, when processing bars having a standard length of 6÷12 m, the rollers of the bar braking device must be slowed down and then re-accelerated within a very short space of time, resulting in excessive power consumption. For a 6 m-long bar arriving at a speed of 40 m/s, the amount of time available for slowing the bar down and then re-accelerating the rollers is just 0.6 s. A conventional bar braking device would use approximately 800 kW. Furthermore, the device that opens and closes the rollers must react rapidly in terms of response and actuation times. In the case cited above the time available for closing the rollers is approximately 0.06 s. Consequently the pneumatic devices known in the prior art with a 6 bar operating pressure cannot satisfy these specifications.

Other bar braking devices known in the prior art consist of static caliper devices. Although said caliper devices are advantageous in terms of braking times, they do not allow a correct and repeatable bar unloading speed to be achieved since, in this case, said unloading speed is highly dependent on the braking power. Furthermore, the braking power depends on the crushing force of the caliper and on the friction coefficient, which in turn depends on the temperature of the bar and of the caliper, both of which are low-sensitivity controllable parameters.

These drawbacks have now been overcome with a bar speed changing device that embodies the advantages of the devices known in the prior art but not the drawbacks.

SUMMARY OF THE INVENTION

One of the main purposes of this invention is to produce a bar speed changing device that, by selecting different roller rotation speeds, uses less power and thus enables considerable energy saving, while complying with the times available for slowing down and then re-accelerating the rollers of the device in order to slow down or accelerate bars of a predefined length.

Another purpose is to guarantee, by adjusting the speed of the rollers, the correct and repeatable unloading speed and improved flexibility of the bar processing plant.

Another purpose is to improve the grip on the bars by ensuring better contact between the rollers, or other rotating means, and the bars.

This invention therefore overcomes the drawbacks described above with a bar speed changing device to change a first speed at which bars of a given length travel along the axis thereof after leaving a rolling train up to a second speed at which said bars are fed, comprising at least one first pair of rotating means, having their respective axes of rotation parallel to one another, so as to create a support for the bars, at least one second pair of rotating means, having their respective axes of rotation parallel to one another, arranged at a predefined distance from the first pair of rotating means, in order to define an intermediate passage for the bars, in which the bars can slide axially, motors that make the rotating means of the first and second pairs rotate around their respective axes at a controlled tangential speed during bar feed, means for controlling the speed of the rotating means and actuator means that bring the rotating means of the second pair closer to the first pair, so that the bar can be gripped between the rotating means during the movement to generate friction between the rotating means and the bars, and then move the rotating means of the second pair away from the first pair.

Said bar speed changing device receives a bar section, cut to a predefined length by a cutting-to-length shearing machine, with the rollers open and rotating at a given speed. Said sections, when leaving the device, are fed into axially arranged peripheral seats of rotating drum channels, also simply referred to as channels.

Control devices calculate the speed at which the bar sections must be released, upon completion of the braking action exerted by the device, according to the position that said section must occupy in one of said seats and on the basis of the bar-seat friction coefficient. Said speed at which the section is released is lower than that at which the section arrives in case of bars with a small cross-section and may be higher than that at which the section arrives in case of bars with a large cross-section. In the former case the device acts as a bar braking device, in the latter it accelerates the bar sections.

When the rollers of the device receive the bar, they turn at the calculated release speed. At a predefined moment, such to enable braking in the correct space and time, the rollers close on the section and exert the braking action, exploiting the dynamic friction between the roller-section. During braking a motor controls the rollers via a train of gears, so that the peripheral speed of said rollers is the same as that calculated for unloading the section. The speed at which the rollers rotate tends to increase due to the pull exerted by the section on the rollers.

The actual release speed only coincides with the calculated speed, and thus with the peripheral speed of the rollers, if the crushing force is sufficient to slow the bar to said calculated speed. The release speed may be higher than the calculated speed, but is guaranteed not to fall below said speed.

After a given time from the end of the braking phase, the rollers of the bar braking device open to receive the next section and accelerate or decelerate in order to adjust their peripheral speed to the new value that has been calculated to release the next section, as said speed may be different to that required to unload the previous section.

The bar braking effect is produced as the two upper rollers, which can tilt, move towards the corresponding lower rollers that remain fixed in their position. The fact that only the two upper rollers move means that the inertia involved is halved, reducing the impact on the bar and thus eliminating any risk of deformation. The device that opens and closes the upper rollers reacts extremely rapidly and has very short response and actuation times. Said device comprises, for each of the two upper rollers a mixed hydraulic-pneumatic system with two cylinders.

The lower rollers are not of the tilting type but can be adjusted, as a function of the cross-section of the bar to be slowed, by means of a single device that acts, via a tie rod, on the roller holder lever of one of the two lower rollers. The movement of said lever activates the corresponding lever of the other roller by means of a gearwheel coupling between said levers.

Thus, the bar speed changing device according to this invention embodies all the advantages of the bar braking devices in the prior art but without the drawbacks thereof; in other words:

- the braking device is of a type that is known in the prior art and only requires some minor adjustments;
- compared to the conventional use of the bar braking device, the rollers do not have to be accelerated to rotate at the speed at which the bar section arrives, requiring only a slight adjustment to their speed and thus involving the use of less power; for example the device according to this invention uses approximately 40 kW to slow down a 6 m-long bar arriving at a speed of 40 m/s, about a twentieth of that required by a conventional bar braking device;
- as regards the calipers, the correct unloading speed is guaranteed by the rotation of the rollers;
- finally, the possibility of obtaining different bar section unloading speeds ensures greater flexibility within the bar processing plant.

In this description reference is only made to the case in which the device is used as a bar braking device, but the same advantages are obtained when the device is used to accelerate the bars, when processing bars having special cross-sections. The claims describe alternative preferred embodiments of the invention.

BRIEF DESCRIPTION OF THE DRAWINGS

Further characteristics and advantages of this invention will become clear from the following detailed description of a preferred, but not exclusive, embodiment of a bar speed changing device that is merely illustrative and not limitative, with the help of the drawings that are attached hereto, in which.

DETAILED DESCRIPTION OF PREFERRED EMBODIMENTS OF THE INVENTION

Figure 1A:
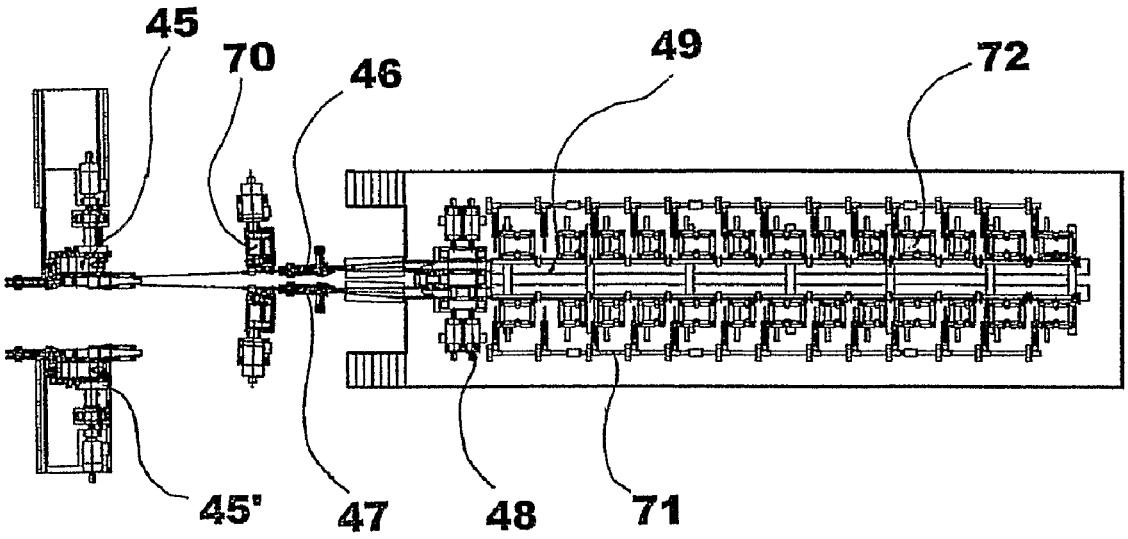
FIG. 1*a* is a general view from above of a portion of the bar processing plant of which the bar speed changing device according to this invention is part.

With reference to the drawings, a bar processing plant is now described. Said plant comprises:

- a cutting-to-length shearing machine 45 with integrated deflector device;
- two deflector devices 46 and 47 that divert the bars towards four unloading lines;
- a four-way bar braking assembly, comprising four bar speed changers 48. For the sake of simplicity, in the following description reference is only made to one of the two functions of the speed changer, namely to that in which it is used as a brake, and it is simply called a bar braking device. The term bar braking device thus also refers to the case in which the bars are made to accelerate;
- two twin-channel rotating assemblies 49, i.e. four rotating drum channels 50, 51, 52, 53;
- a device with one or more conveyors 60, 61, 62, 63 to unload the bar sections.

Figure 1B:
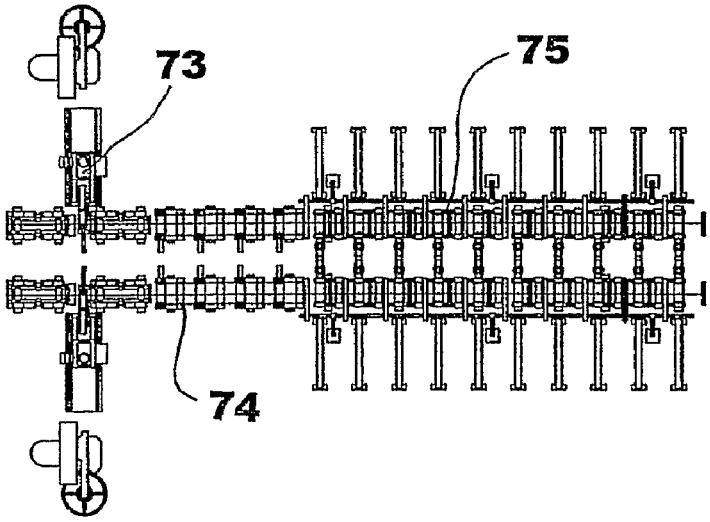
FIG. 1*b* is a general view from above of a second portion of the of the plant in FIG. 1*a;*

The cutting-to-length shearing machine 45 advantageously, but not necessarily, cuts the bars coming from a rolling mill, which is not illustrated in FIG. 1, to a predefined length. The bar sections thus obtained, hereafter simply referred to as sections, are directed along two guideways leading from the cutting-to-length shearing machine 45 by means of a deflector device that may be integrated into said cutting-to-length shearing machine 45. The sections travel along the two guideways to the two deflector devices 46, 47 that direct them to four unloading lines.

At the beginning of the four unloading lines there is the bar braking assembly that comprises four bar braking devices 48. Each bar braking device 48 receives a bar section with the rollers 55, 55', 59, 59' in the open position and rotating at a given speed. The bar sections preferably arrive at the bar braking device 48 from the right along the X axis. Upon leaving the bar braking device 48, said sections are fed into axially arranged peripheral seats 58 of rotating drum channels, also simply referred to as channels.

Control devices calculate the speed at which the bar sections must be released, upon completion of the braking action exerted by the bar braking device 48, according to the position that said section must occupy in one of said seats and on the basis of the bar-seat friction coefficient.

Said speed at which the section is released is lower than that at which the section arrives in case of bars with a small cross-section and may be higher than that at which the section arrives in case of bars with a large cross-section. In this particular case the bar braking device accelerates the bar sections.

When the rollers 55, 55', 59, 59' of the bar braking device 48 receive the bar, they turn at the calculated release speed.

At a predefined moment, such to enable braking in the correct space and time, the rollers 55, 55', 59, 59' close on the section and exert the braking action, exploiting the dynamic friction between the roller-section.

During braking a motor controls the rollers 55, 55', 59, 59' via a train of gears 84, so that the peripheral speed of said rollers is the same as that calculated for unloading the section. The speed at which the rollers 55, 55', 59, 59' rotate tends to increase due to the pull exerted by the section on the rollers.

The actual release speed only coincides with the calculated speed, and thus with the peripheral speed of the rollers 55, 55', 59, 59' if the crushing force is sufficient to slow the bar to said calculated speed. The release speed may be higher than the calculated speed, but is guaranteed not to fall below said speed.

After a given time from the end of the braking phase, the rollers 55, 55', 59, 59' of the bar braking device 48 open to receive the next section and accelerate or decelerate in order to adjust their peripheral speed to the new value that has been calculated to release the next section, as said speed may be different to that required to unload the previous section.

The braking effect is produced as the two upper rollers 55, 55', which can tilt, move towards the corresponding lower rollers 59, 59' that remain fixed in their position.

The fact that only the two upper rollers 55, 55' move means that the inertia involved is halved, reducing the impact on the bar and thus eliminating any risk of deformation.

The device that opens and closes the upper rollers 55, 55' reacts extremely rapidly and has very short response and actuation times. For example, the time available for closing the rollers 55, 55' is approximately 0.06 s.

Said device comprises, for each of the two upper rollers 55, 55' a mixed hydraulic-pneumatic system with two cylinders 56 and 57. One pneumatic cylinder 56 is of the push type and receives a constant pressure supply, with the pressure being equal to that needed to generate the braking force on the section. This pneumatic cylinder 56 closes the rollers 55, 55' and is not controlled by a valve.

One hydraulic cylinder 57 is of the pull type and is controlled by a solenoid valve with short response times. When the rollers 55, 55' must close on the section the solenoid valve is activated to reduce the hydraulic pressure of the cylinder 57, so that the pressure in the pneumatic cylinder 56 closes the rollers 55, 55' to reduce the speed of the section.

At a given moment after the end of the braking phase, the solenoid valve is activated and opens the rollers 55, 55' in order to restore the hydraulic pressure and thus the pulling pressure of the hydraulic cylinder 57.

The presence of two autonomous systems for opening and closing the upper rollers, one for the rollers 55 and one for the rollers 55', means that said rollers can be activated independently to ensure an even contact between the rollers and the bar that is being gripped, especially when handling ribbed bars for reinforced concrete.

The lower rollers 59, 59' are not of the tilting type but can be adjusted, as a function of the cross-section of the bar to be slowed, by means of a single device 80 that acts, via a tie rod 81, on the roller holder lever 82 of one of the two lower rollers 59, 59'. The movement of said lever 82 activates the corresponding lever of the other roller by means of a gearwheel coupling between said levers.

Figure 2:
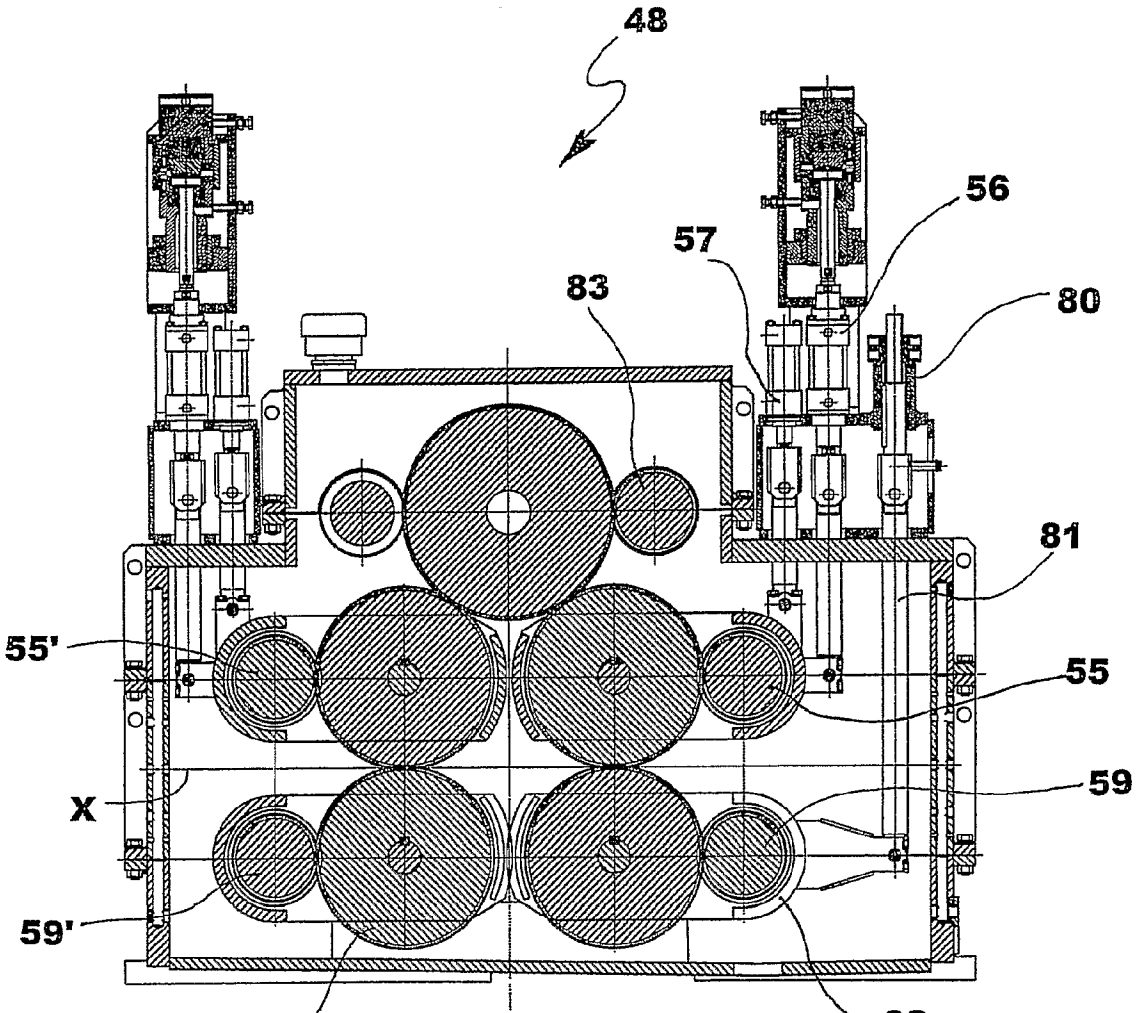
FIG. 2 is a cross-section of the bar speed changing device according to this invention, that is part of the plant in FIG. 1*a;*
Figure 3:
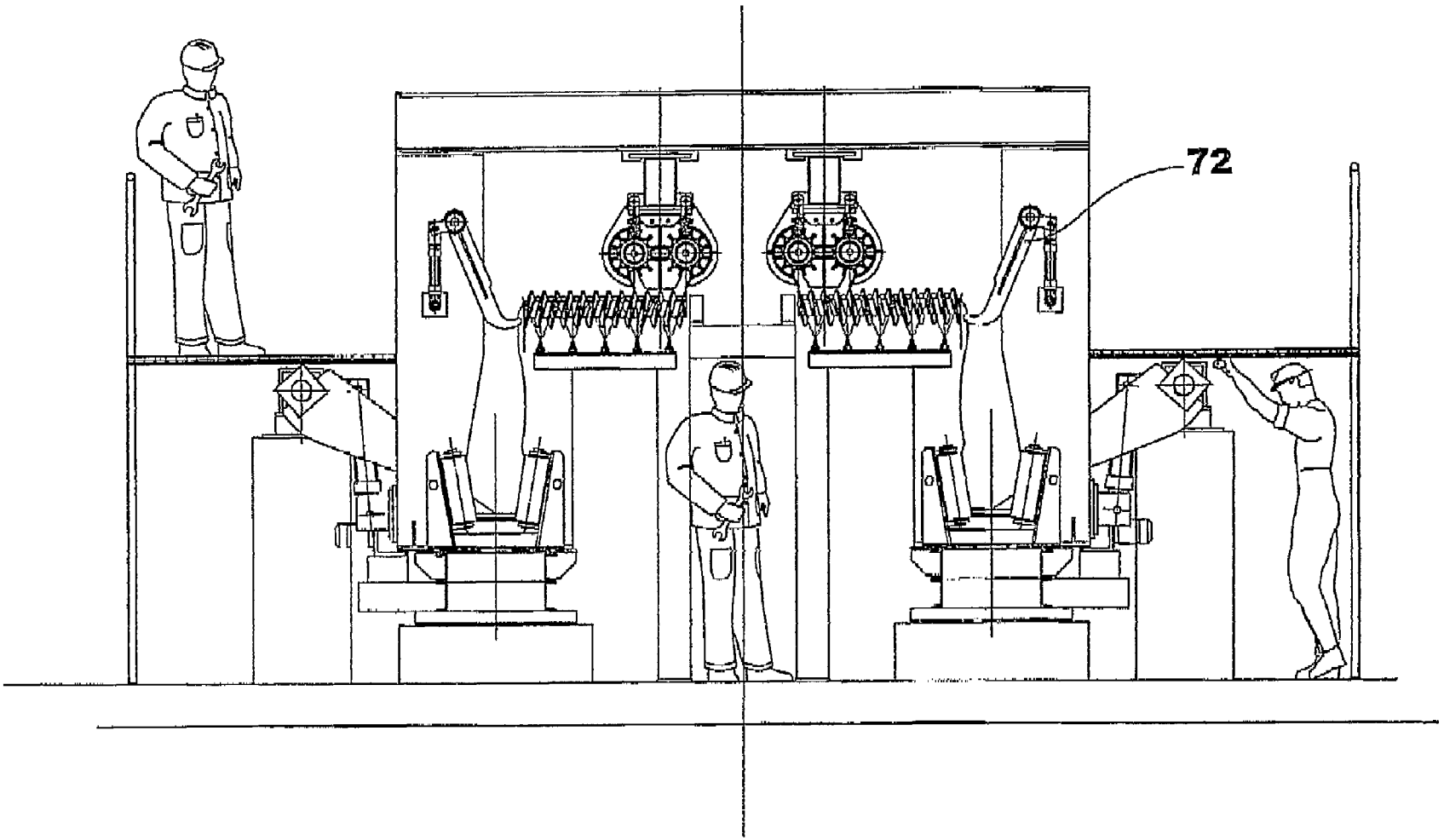
FIG. 3 is a side view of some parts of the plant bar processing plant.

The rotation mechanism of the rollers 55, 55', 59, 59' comprises a driving motor 83 and a train of gears 84, as illustrated in FIG. 2.

According to one advantageous alternative form of this invention, more than one pair of upper and lower rollers can be used for each bar braking device.

According to another advantageous alternative form of this invention, pairs of upper and lower rotating means, having their respective axes of rotation basically orthogonal to the feed axis of the bar sections, can be used to transmit motion to respective upper and lower tracked belts, wrapped around said rotating means. In this way the braking action, or acceleration, is exerted on the bar section by means of the friction between said section and the upper and lower tracked belts.

The sections, cut to a standard length and slowed down as described above, are then fed into the axially arranged peripheral seats 58 in the channels.

The system used to unload the bar sections, illustrated in the drawings, comprises four rotating drum channels 50, 51, 52, 53. The length of said channels is equal to at least twice the length of the sections and their peripheral seats 58 are divided into two sectors, an initial sector and a final sector, that are at least as long as one bar section. For example, in case of sections that are 6 m long, the length of the initial and final sectors of the seats 58 is respectively 6 m plus a safety distance. The length of the channel is thus at least 12 m plus the safety distance.

Under the channels 50, 51, 52, 53, there is a device that collects and removes the sections that have been unloaded from said channels. Said removal device may comprise one or more conveyors. Said conveyors, for example, comprise a worm or worm assembly capable of transferring the sections, basically orthogonally or in any case transversely in relation to their axis, to one or more collection bags, or to guideways or roller conveyors. In the example illustrated in the drawings, the four conveyors 60, 61, 62, 63 can be operated separately and the screws that are used are of the double-threaded type, but other screws may be used. The conveyors 60 and 62 deliver sections to the final sectors of the seats 58; the conveyors 61 and 63 deliver sections to the initial sectors of said seats.

A first passage phase in which the sections are delivered one at a time alternately into the initial and final sectors of the peripheral seats 58 in sequence until these are completely full, is followed by a steady state phase in which, for each section delivered into a sector of a seat 58, another section, that was delivered previously, is unloaded from the channel onto the relative conveyor.

The unloading operation, which is described below, makes it possible to reduce the time required to transport the sections on the conveyors 60, 61, 62, 63, once they have been unloaded from the channels 50, 51, 52, 53, compared to systems known in the prior art.

Figure 4B:
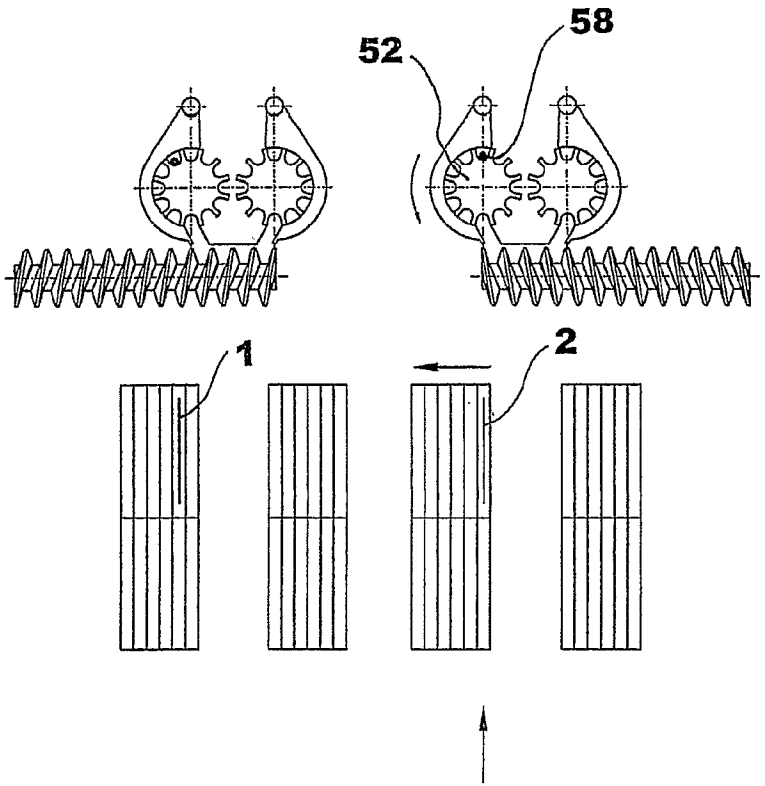
FIGS. 4*a* to 4*h* illustrate a first sequence of steps that comprise the process when the bar processing plant is started.
Figure 4A:
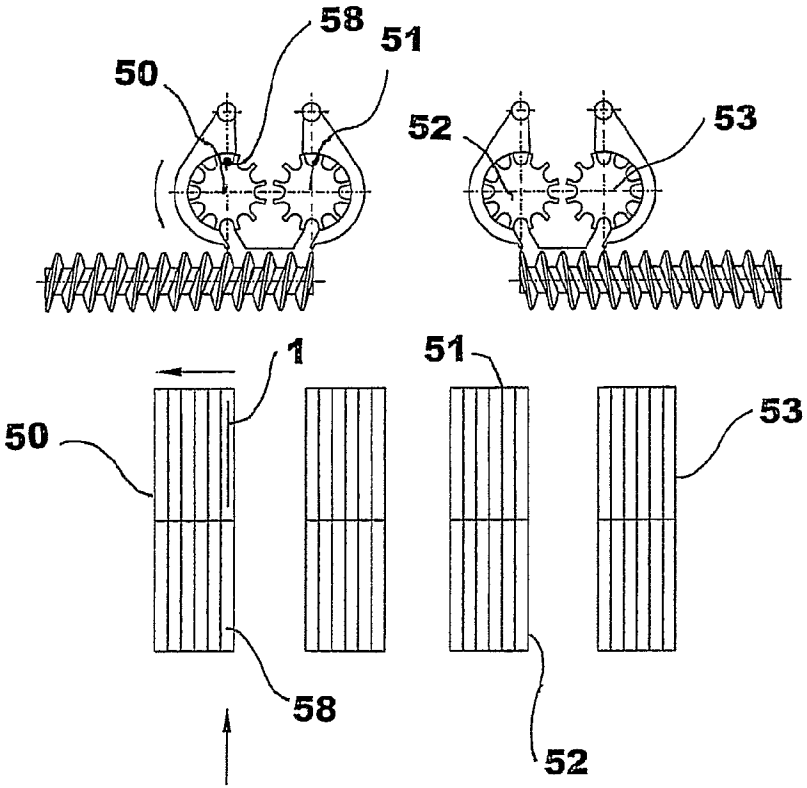
Figure 4D:
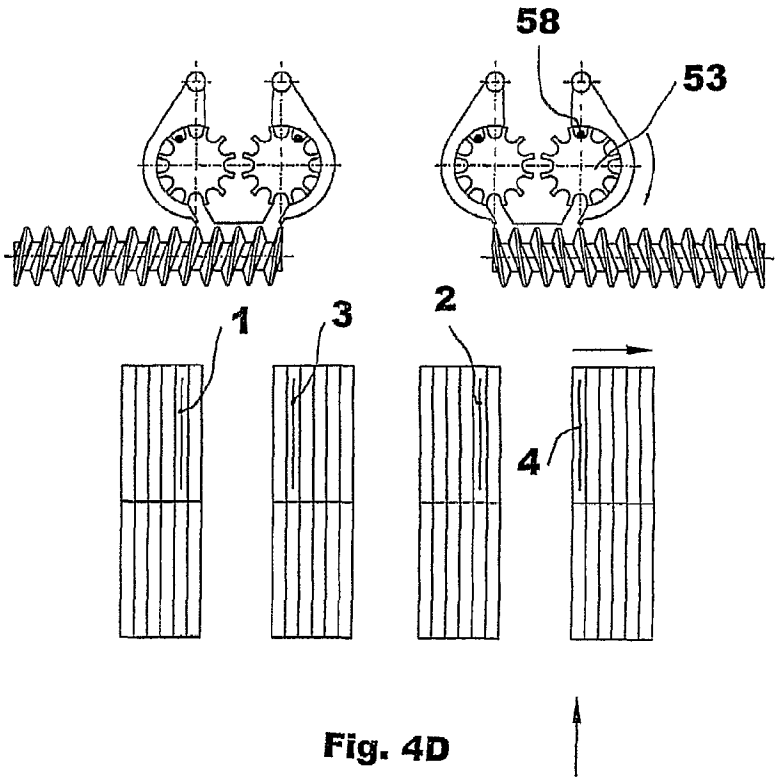
Figure 4C:
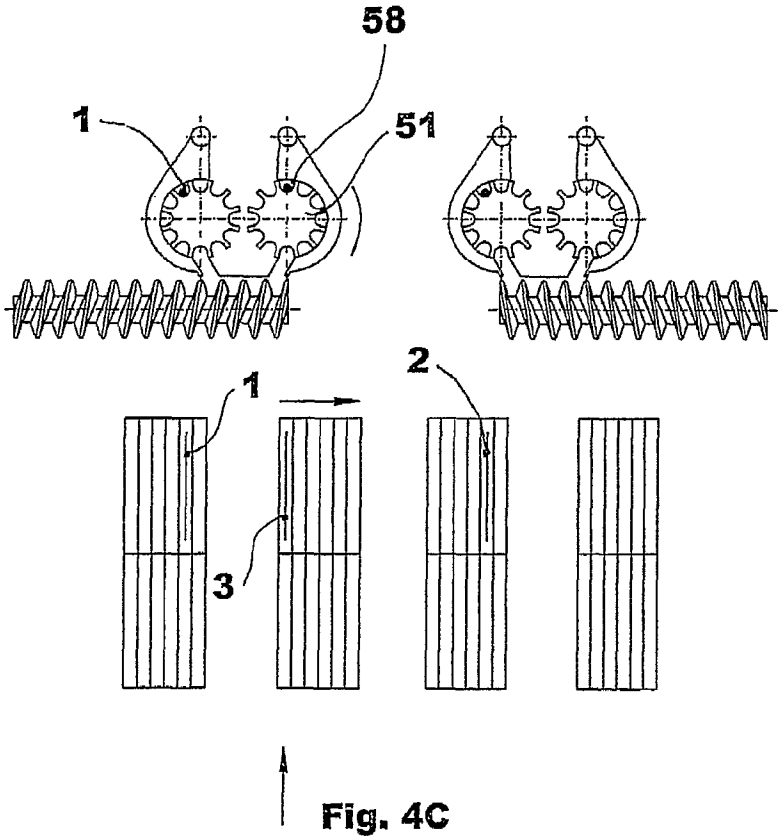
Figure 4F:
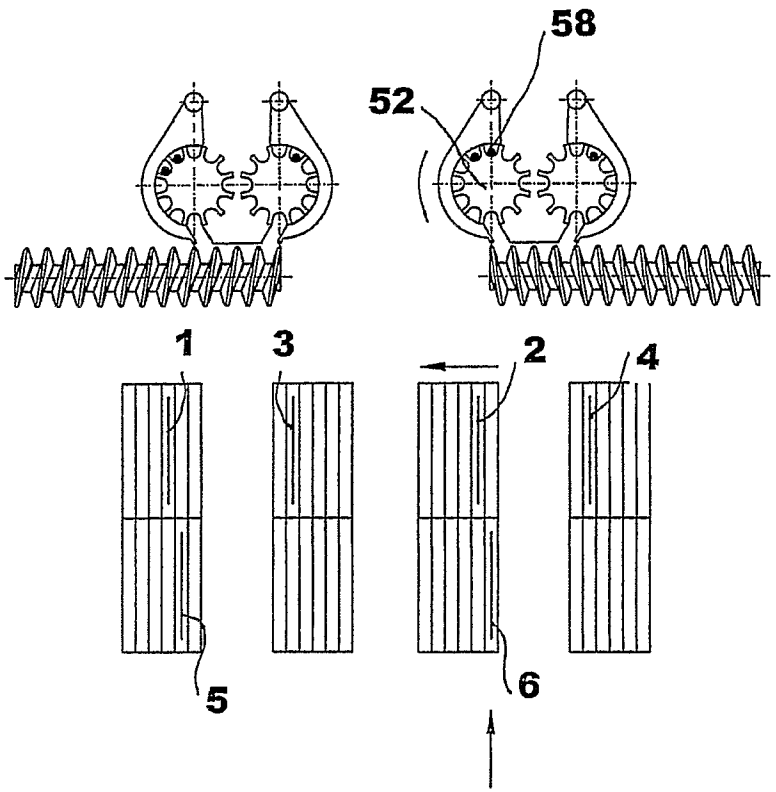
Figure 4E:
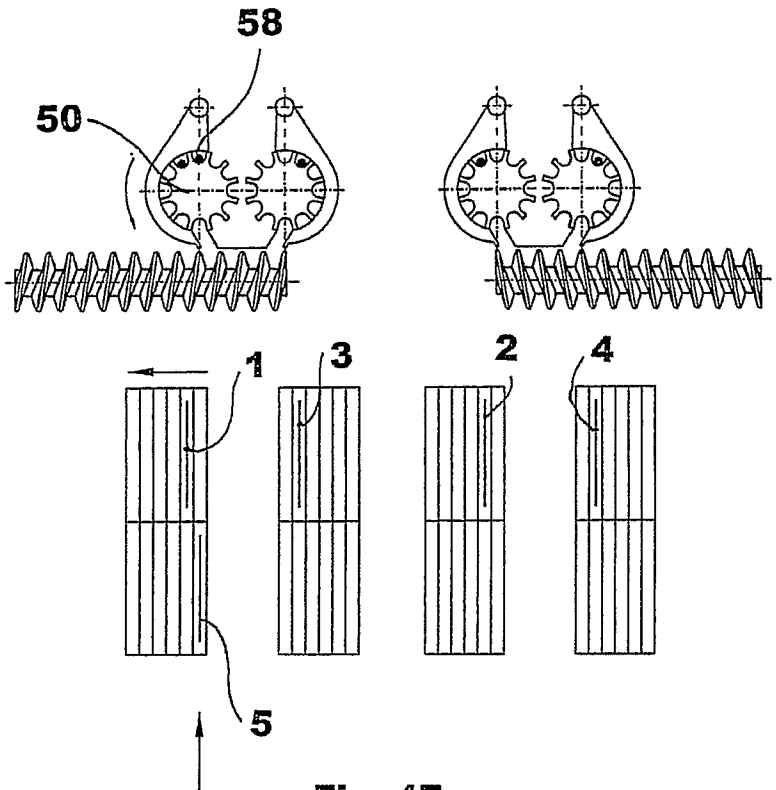
Figure 4H:
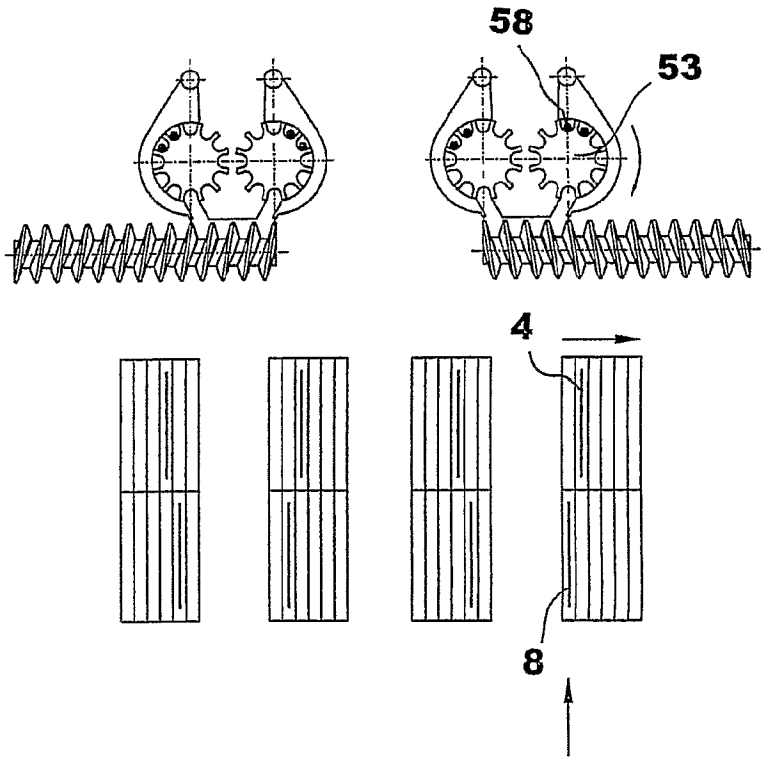
Figure 4G:
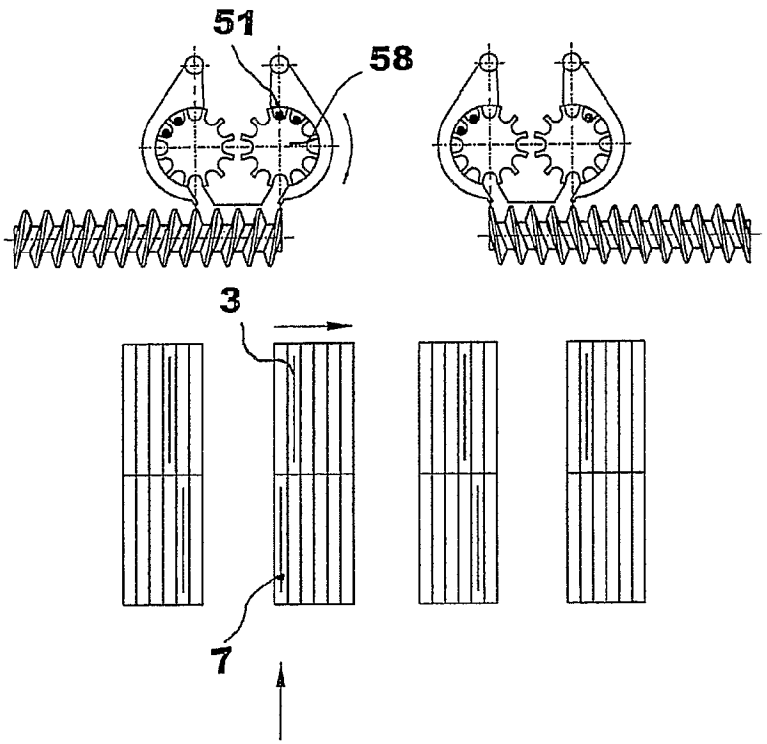
Figure 5B:
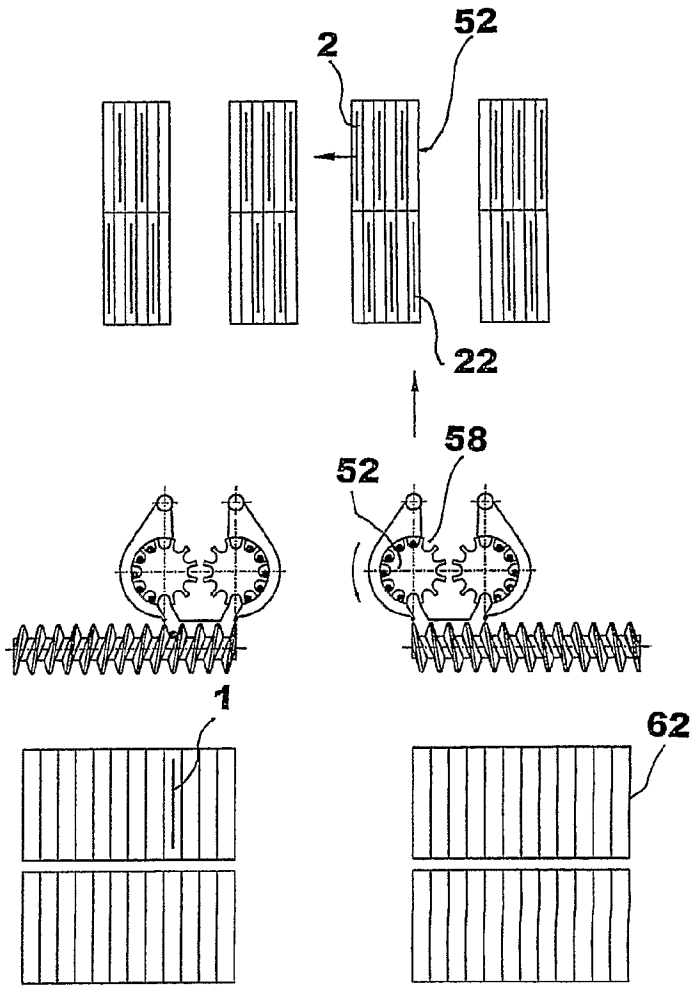
FIGS. 5*a* to 5*h* illustrate a second sequence of steps that comprise the process during steady state operation of the bar processing plant.
Figure 5A:
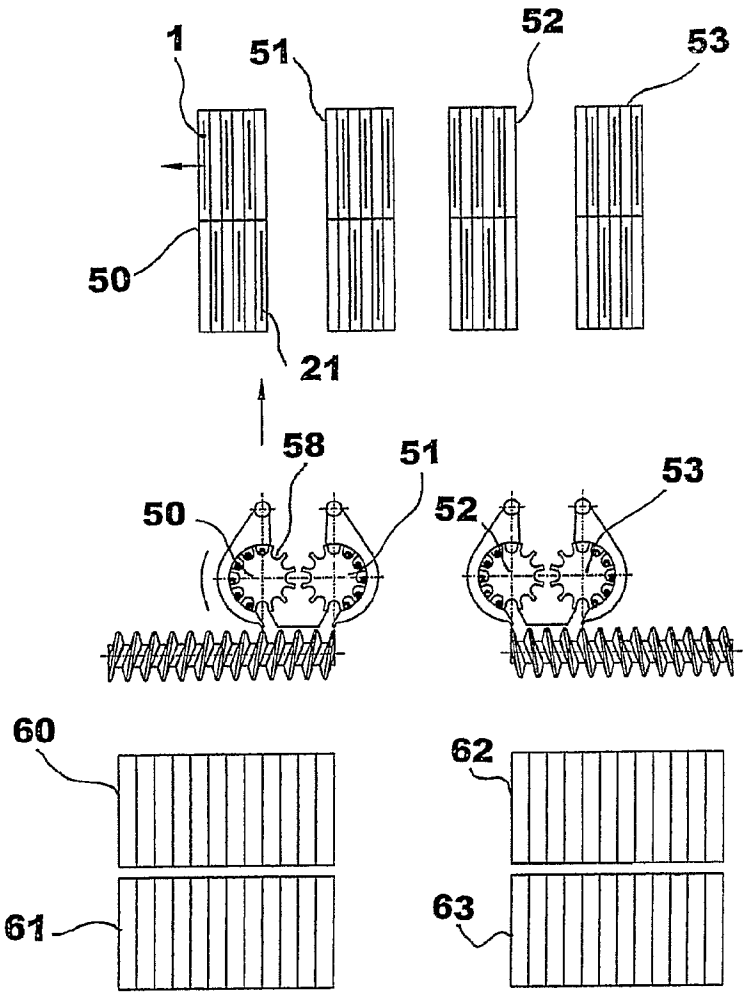
Figure 5D:
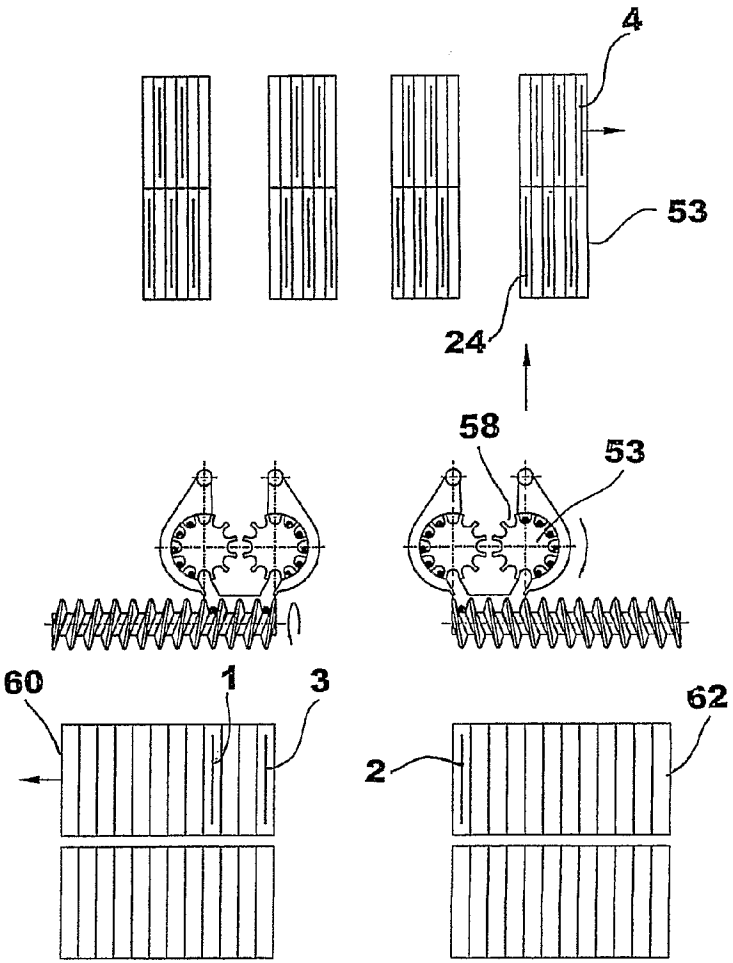
Figure 5C:
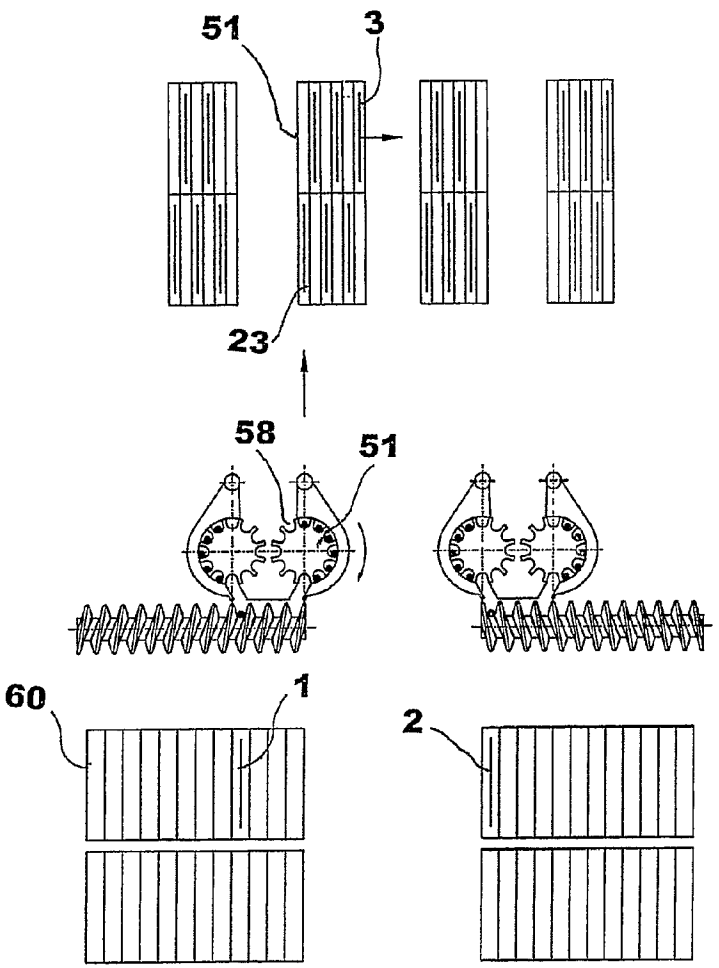
Figure 5F:
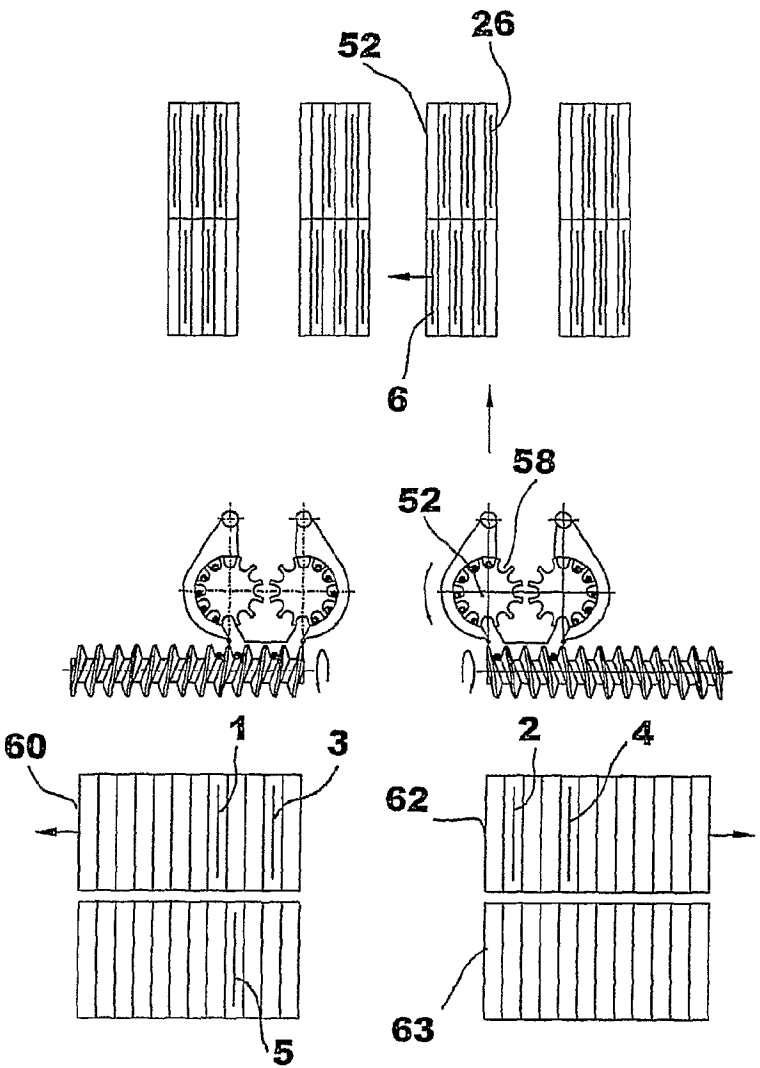
Figure 5E:
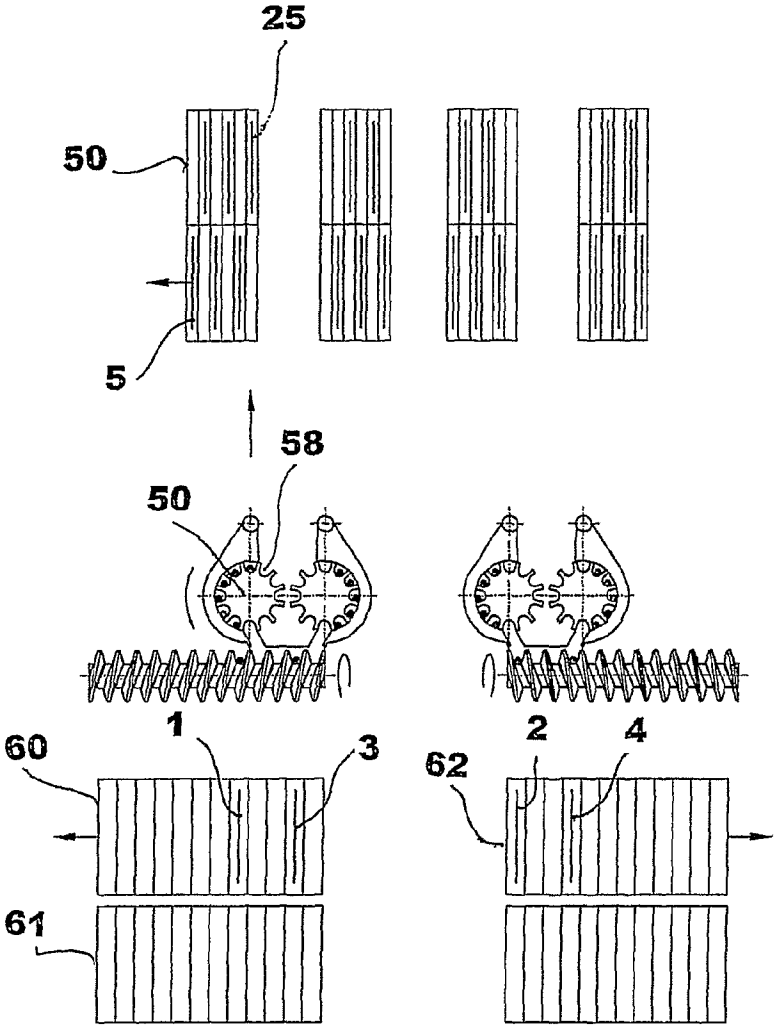
Figure 5H:
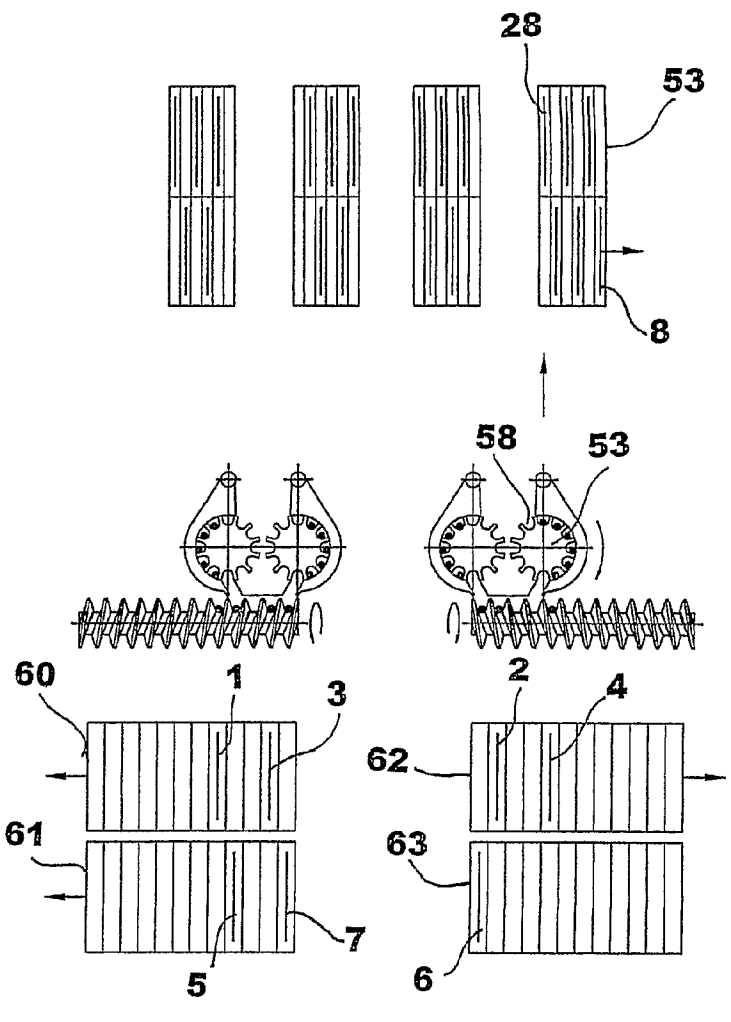
Figure 5G:
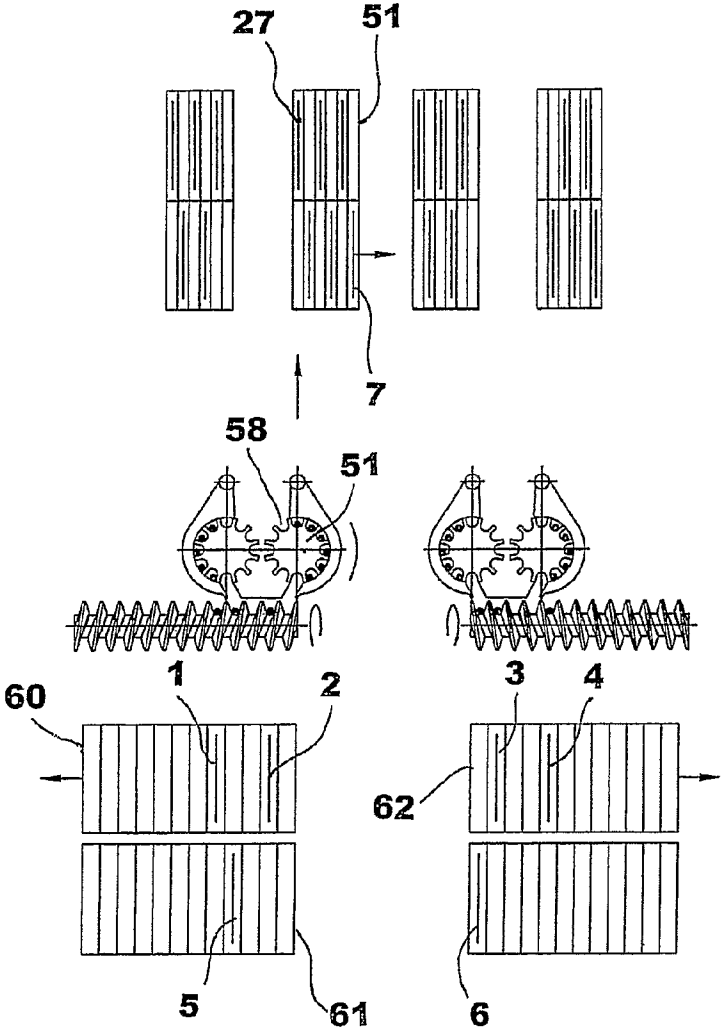

In the passage phase the sections, the flow of which is indicated by the arrows at the bottom of FIGS. 4*a* to 4*h*, are fed into the peripheral seats 58 of the four rotating drum channels 50, 51, 52, 53 as described below:

1. section 1 is fed into a seat 58 in the channel 50 at a first speed such that it is able to stop in the final sector of said channel 50 (FIG. 4*a*). Said speed is controlled by the bar braking device 48. Once the tail end of section 1 has entered the seat 58, the channel 50 starts to rotate so that it is ready to receive section 5 in the initial sector of the next seat; (FIG. 4*e*)
2. section 2 is fed into a seat 58 in the channel 52 at a speed such that it is able to stop in the final sector of said channel 52 (FIG. 4*b*). Once the tail end of section 2 has entered the seat, it starts to rotate so that it is ready to receive section 6 in the initial sector of the next seat; (FIG. 4*f*)
3. section 3 is fed into a seat 58 in the channel 51 at a speed such that it is able to stop in the final sector of said channel 51 (FIG. 4*c*). Once the tail end of section 3 has entered the seat, it starts to rotate so that it is ready to receive section 7 in the initial sector of the next seat; (FIG. 4*g*)
4. section 4 is fed into a seat 58 in the channel 53 at a speed such that it is able to stop in the final sector of said channel 53 (FIG. 4*d*). Once the tail end of section 4 has entered the seat, it starts to rotate so that it is ready to receive section 8 in the initial sector of the next seat; (FIG. 4*h*)
5. section 5 is fed into a seat 58 in the channel 50, after that of section 1, at a second speed such that it is able to stop in the initial sector of said channel 50 (FIG. 4*e*). The second speed of the sections is also controlled by the bar braking device 48. Once the tail end of section 5 has entered the seat, it starts to rotate so that it is ready to receive section 9 in the final sector of the next seat;

6. section 6 is fed into a seat 58 in the channel 52, after that of section 2, at a speed such that it is able to stop in the initial sector of said channel 52 (FIG. 4*f*). Once the tail end of section 6 has entered the seat, it starts to rotate so that it is ready to receive section 10 in the final sector of the next seat;
7. section 7 is fed into a seat 58 in the channel 51, after that of section 3, at a speed such that it is able to stop in the initial sector of said channel 51 (FIG. 4*g*). Once the tail end of section 7 has entered the seat, it starts to rotate so that it is ready to receive section 11 in the final sector of the next seat;
8. section 8 is fed into a seat 58 in the channel 53, after that of section 4, at a speed such that it is able to stop in the initial sector of said channel 53 (FIG. 4*h*). Once the tail end of section 8 has entered the seat, it starts to rotate so that it is ready to receive section 12 in the final sector of the next seat;
9. the cycle is repeated from step 1) with section 9.

When the initial and final sectors of all the peripheral seats 58 in the four rotating drum channels 50, 51, 52, 53 are full, the processing plant steady state phase starts in which the sections are unloaded onto the conveyors 60, 61, 62, 63 and transferred to the collection bags and new sections are loaded into the empty seats. The section unloading process consists of the following steps, as illustrated in FIGS. 5*a* to 5*h*:

a) after section 21 has been fed into the initial sector of a seat 58 in the channel 50, said channel starts to rotate in order to unload section 1 onto the relative conveyor 60;
b) after section 22 has been fed into the initial sector of a seat 58 in the channel 52, said channel starts to rotate in order to unload section 2 onto the relative conveyor 62;
c) after section 23 has been fed into the initial sector of a seat 58 in the channel 51, said channel starts to rotate in order to unload section 3 onto the relative conveyor 60. Said conveyor starts to translate the relative sections, transversely in relation to its axis, moving them by one screw pitch and thus by two spaces, since in this embodiment double-threaded screws are used;
d) after section 24 has been fed into the initial sector of a seat 58 in the channel 53, said channel starts to rotate in order to unload section 4 onto the relative conveyor 62. Said conveyor starts to translate the relative sections, moving them by one screw pitch and thus by two spaces. The conveyor 60 continues to translate sections 1 and 3;
e) after section 25 has been fed into the final sector of a seat 58 in the channel 50, said channel starts to rotate in order to unload section 5 onto the relative conveyor 61. The conveyors 60 and 62 continue to translate sections 1, 3 and 2, 4 respectively;
f) after section 26 has been fed into the final sector of a seat 58 in the channel 52, said channel starts to rotate in order to unload section 6 onto the relative conveyor 63. The conveyors 60 and 62 continue to translate sections 1, 3 and 2, 4 respectively;
g) after section 27 has been fed into the final sector of a seat 58 in the channel 51, said channel starts to rotate in order to unload section 7 onto the relative conveyor 61. Said conveyor starts to translate the relative sections, moving them by one screw pitch and thus by two spaces. The conveyors 60 and 62 continue to translate sections 1, 3 and 2, 4 respectively;
h) after section 28 has been fed into the final sector of a seat 58 in the channel 53, said channel starts to rotate in order to unload section 8 onto the relative conveyor 63. Said conveyor starts to translate the relative sections, moving them by one screw pitch and thus by two spaces. The conveyor 60 stops to receive sections 9 and 11. The conveyors 62 and 61 continue to translate sections 2, 4 and 5, 7 respectively;
i) after section 29 has been fed into the initial sector of a seat 58 in the channel 50, said channel starts to rotate in order to unload section 9 onto the relative conveyor 60. The conveyor 62 stops to receive sections 10 and 12. The conveyors 61 and 63 continue to translate sections 5, 7 and 6, 8 respectively;
j) after section 30 has been fed into the initial sector of a seat 58 in the channel 52, said channel starts to rotate in order to unload section 10 onto the relative conveyor 62. The conveyors 61 and 63 continue to translate sections 5, 7 and 6, 8 respectively;
k) after section 31 has been fed into the initial sector of a seat 58 in the channel 51, said channel starts to rotate in order to unload section 11 onto the relative conveyor 60. Said conveyor starts to translate the relative sections, moving them by one screw pitch and thus by two spaces. The conveyors 61 and 63 continue to translate sections 5, 7 and 6, 8 respectively;
l) after section 32 has been fed into the initial sector of a seat 58 in the channel 53, said channel starts to rotate in order to unload section 12 onto the relative conveyor 62. Said conveyor starts to translate the relative sections, moving them by one screw pitch and thus by two spaces. The conveyor 61 stops to receive sections 13 and 15. The conveyors 60 and 63 continue to translate sections 1, 3, 9, 11 and 6, 8 respectively;
m) after section 33 has been fed into the final sector of a seat 58 in the channel 50, said channel starts to rotate in order to unload section 13 onto the relative conveyor 61. The conveyor 63 stops to receive sections 14 and 16. The conveyors 60 and 62 continue to translate sections 1, 3, 9, 11 and 2, 4, 10, 12 respectively;
n) after section 34 has been fed into the final sector of a seat 58 in the channel 52, said channel starts to rotate in order to unload section 14 onto the relative conveyor 63. The conveyors 60 and 62 continue to translate sections 1, 3, 9, 11 and 2, 4, 10, 12 respectively;
o) after section 35 has been fed into the final sector of a seat 58 in the channel 51, said channel starts to rotate in order to unload section 15 onto the relative conveyor 61. Said conveyor starts to translate the relative sections, moving them by one screw pitch and thus by two spaces. The conveyors 60 and 62 continue to translate sections 1, 3, 9, 11 and 2, 4, 10, 12 respectively;
p) after section 36 has been fed into the final sector of a seat 58 in the channel 53, said channel starts to rotate in order to unload section 16 onto the relative conveyor 63. Said conveyor starts to translate the relative sections, moving them by one screw pitch and thus by two spaces. The conveyor 60 stops to receive sections 17 and 19. The conveyors 61 and 62 continue to translate sections 5, 7, 13, 15 and 2, 4, 10, 12 respectively;
q) after section 37 has been fed into the initial sector of a seat 58 in the channel 50, said channel starts to rotate in order to unload section 17 onto the relative conveyor 60. The conveyor 62 stops to receive sections 18 and 20. The conveyors 61 and 63 continue to translate sections 5, 7, 13, 15 and 6, 8, 14, 16 respectively;
r) after section 38 has been fed into the initial sector of a seat 58 in the channel 52, said channel starts to rotate in order to unload section 18 onto the relative conveyor 62.

The conveyors 61 and 63 continue to translate bars 5, 7, 13, 15 and 6, 8, 14, 16 respectively;

s) after section 39 has been fed into the initial sector of a seat 58 in the channel 51, said channel starts to rotate in order to unload section 19 onto the relative conveyor 60. Said conveyor starts to translate the relative sections, moving them by one screw pitch and thus by two spaces. The conveyors 61 and 63 continue to translate sections 5, 7, 13, 15 and 6, 8, 14, 16 respectively;

t) after section 40 has been fed into the initial sector of a seat 58 in the channel 53, said channel starts to rotate in order to unload section 20 onto the relative conveyor 62. Said conveyor starts to translate the relative sections, moving them by one screw pitch and thus by two spaces. The conveyor 61 stops to receive sections 21 and 23. The conveyors 60 and 63 continue to translate sections 1, 3, 9, 11, 17, 19 and 6, 8, 14, 16 respectively;

u) after section 41 has been fed into the final sector of a seat 58 in the channel 50, said channel starts to rotate in order to unload section 21 onto the relative conveyor 61. The conveyor 63 stops to receive sections 22 and 24. The conveyors 60 and 62 continue to translate sections 1, 3, 9, 11, 17, 19 and 2, 4, 10, 12, 18, 20 respectively;

v) after section 42 has been fed into the final sector of a seat 58 in the channel 52, said channel starts to rotate in order to unload section 22 onto the relative conveyor 63. The conveyors 60 and 62 continue to translate sections 1, 3, 9, 11, 17, 19 and 2, 4, 10, 12, 18, 20 respectively;

w) after section 43 has been fed into the final sector of a seat 58 in the channel 51, said channel starts to rotate in order to unload section 23 onto the relative conveyor 61. Said conveyor starts to translate the relative sections, moving them by one screw pitch and thus by two spaces. The conveyors 60 and 62 continue to translate sections 1, 3, 9, 11, 17, 19 and 2, 4, 10, 12, 18, 20 respectively;

x) after section 44 has been fed into the final sector of a seat 58 in the channel 53, said channel starts to rotate in order to unload section 24 onto the relative conveyor 63. Said conveyor starts to translate the relative sections, moving them by one screw pitch and thus by two spaces. The conveyor 60 stops to receive sections 25 and 27. The conveyors 61 and 62 continue to translate sections 5, 7, 13, 15 and 2, 4, 10, 12, 18, 20 respectively;

y) the cycle is repeated in the same way from point a).

With this layout of the components and when the sections are delivered into and unloaded from the rotating drum channels as described above, this processing plant is capable, for example, with sections ranging from between 6 m and 12 m in length and with 6÷10 mm diameter bars arriving at speeds of 40 m/s and 36 mm diameter bars arriving at speeds of 4 m/s, of a production output of 100 t/h.

The main advantages of the layout and structure of the components described above are:

reduced line length; in conventional plants the bars are 60÷80 m in length, which means that the channel must be longer, whereas the length of the channel according to this invention is, for example, approximately 21 m;

reduced initial outlay due to the compactness of the line, since more compact components take up less floor-space in the workshop;

reduced initial outlay due to the fact that the bars are cut directly to the standard length so there is no need for a cooling bed or cutting-to-length shearing machine downstream of the channels;

higher productivity of the bar processing plant compared to conventional systems.

Cutting the bars directly to the standard length means a large number of cutting operations are performed within a given time, with an increase of approximately 30% compared to the current number of cutting operations. This means that the blades of the shearing machine are subject to considerable wear. For this reason the material used to manufacture the blades must be chosen from among those that currently offer the best resistance to wear, in order to ensure the longest possible service life of the blades.

Figure 6:
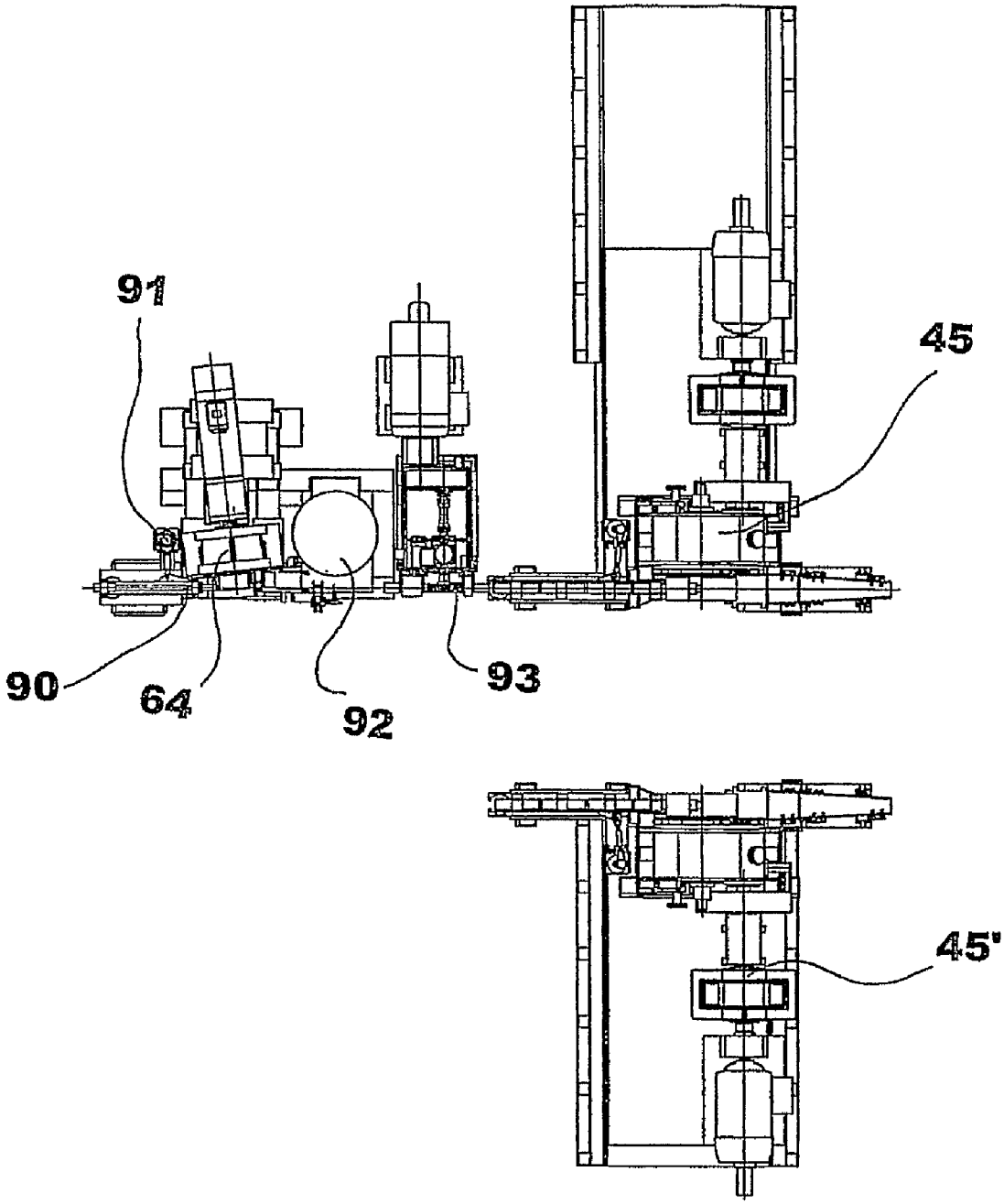
FIG. 6 is a plan view of the scrap shearing machine/cutting-to-length shearing machine assembly, with a second cutting-to-length shearing machine installed in parallel.

According to one advantageous embodiment, the processing plant comprises two cutting-to-length shearing machines 45, 45' in parallel (FIG. 6), one of which is used while the second is on stand-by for servicing, thus enabling continuous production throughout the entire life of the set of blades being used, with a maximum downtime of just 5 minutes in order to change the shearing machine using a traverse trolley, not illustrated in the drawings.

When the bars leave the rolling mill their head ends are not always an equal distance apart. This means that, when a rolled bar arrives beneath the shearing machine 45, which rotates continuously at a constant speed, the blades are in a position such that they do not meet at the right point. This results in errors on the first cut. The shearing position error also occurs on the last section of a bar since the intermediate shearing values are equal to a given number of blade revolutions, which is necessarily a whole number.

The first section that is cut will be longer than the required length, while the last section will be shorter.

Thus in another advantageous embodiment, upstream of the cutting-to-length shearing machine 45, there may be a scrap shearing machine 64 as a means of ensuring that all the bar sections of each rolled bar are the same length, in particular the first and last sections.

Both the scrap shearing machine 64 and the cutting-to-length shearing machine 45 rotate continuously at a constant angular speed and at a peripheral speed that is the same as the speed of the rolling process, for example 40 m/s, and the distance between said machines is a sub-multiple of the standard length to be cut, for example 2 meters. Upstream of the scrap shearing machine 64 there is a single-channel deflector device 90, controlled for example by a cam 91, that tilts alternately along a horizontal plane in order to direct the rolled bar longitudinally either towards the scrap shearing machine 64 or towards the cutting-to-length shearing machine 45.

For each rolled bar, the shearing cycle is performed as follows: after leaving the last rolling stand, the single channel deflector device directs the head end of the bar towards the scrap shearing machine 64, which trims the head and the end section that has been cut off is sent to a suitable collection chamber 92. As soon as the head end has been trimmed, said deflector device directs the bar towards the cutting-to-length shearing machine 45 through which said bar passes for a distance that is equal to the standard length required (6, 8, 12 meters); at the precise moment in which the required length is reached, the blades cross and the first bar section is cut to size.

Subsequent cutting operations are performed with the single-channel deflector device 90 positioned so as to allow the bar to advance towards the cutting-to-length shearing machine 45 that cuts the various sections to the predefined length, since the distance between the blades is equal to said length and the peripheral speed of said blades is the same as the speed at which the rolled bar is delivered. In order to cut even the last section of the rolled bar to the correct length, when the tail end of the bar leaves the rolling unit, the single-channel deflector device 90 directs the tail end towards the scrap shearing machine 64: in this case the blades of the scrap shearing machine cut the last section of the bar to the correct length and at the same time trim the tail. More precisely, when the second-to-last bar section has been cut, the head end of the last section is allowed to pass through the cutting-to-length shearing machine 45 until the sum of the part of the bar that has passed through said shearing machine and the part of the bar between the center-to-center distance of the two shearing machines, the scrap shearing machine and cutting-to-length shearing machine, equals the predefined length: at that moment the end part of the rolled bar is in the point at which the scrap shearing machine blades cross and these cut the bar to the correct length. Also in this case the end part that has been cut off is sent to the collection chamber.

The blades of the cutting-to-length shearing machine 45 are synchronized with those of the scrap shearing machine 64 so that, when the first and last sections are cut, with simultaneous trimming respectively of the head and tail of the rolled bar, said blades are in the correct position at the predefined moment to cut the first and last sections to the predefined length. The synchronization of said blades must take into account the distance between the two shearing machines 64 and 45, their speed of rotation, the speed at which the rolled bar advances and the angular position of the blades. For that purpose the plant according to this invention incorporates sensors, which comprise: means for measuring the speed at which the rolled bar is being fed and for detecting its position on the feed line in relation to the cutting point, means for measuring the angular position of the blades, and calculation means.

Furthermore, since the scrap and cutting-to-length blades rotate continuously, the single-channel deflector device and the rotation of said blades, the position of which must be known at all times, must also be synchronized. For this purpose synchronization means are included, such as, for example, electronic means, between said deflector device and the continuously rotating blades of the two shearing machines 64, 45.

A feeding device 93, downstream of the scrap shearing machine 64, may facilitate the passage of the bars through the cutting-to-length shearing machine 45.

According to another advantageous alternative embodiment, bars can be cut slightly longer or shorter than the standard length, to satisfy specific market requirements, for example to 5.7 m or 6.3 m, without altering the distance between the blades of the shearing machines 64, 45, which is engineered to ensure precision. This is done by changing the speed of rotation of the drums of the shearing machines 64, 45 to obtain the desired length as a function of the speed at which the rolled bar is delivered and the distance of the blades along the circumference of the drums. In particular, the motors associated with the blade holder drums of the scrap shearing machine 64 and the cutting-to-length shearing machine 45 are allowed to oscillate, i.e. they are accelerated so as to obtain overspeeding of the drums in relation to their nominal speed of rotation.

Other alternative embodiments of the processing plant may also comprise:

- two feeding devices 70 on the two lines leading out of the cutting-to-length shearing machine 45;
- two bar section bundling or packaging units 71;
- two vertical elevators 72 associated with the respective horizontal roller conveyers to unload the bar sections;
- two bar section binding machines 73;
- two roller conveyers 74 for transporting bundles or packs;
- two bundle or pack collection bag assemblies 75.

With the use of these components the processing plant is capable of producing packs or bundles of bar sections ready for distribution.

The specific embodiments described in this document are not limitative and this patent application covers all the alternative embodiments of the invention as set forth in the claims.

The invention claimed is:

1. Bar speed changing device, to change a first speed at which bars of a given length travel along an axis (X) thereof after leaving a rolling train up to a second speed at which said bars are fed, comprising:

at least one first pair of rotating means, having their respective axes of rotation parallel to one another, so as to create a support for the bars, at least one second pair of rotating means, having their respective axes of rotation parallel to one another, arranged at a predefined distance from the first pair of rotating means, in order to define an intermediate passage for the bars, in which the bars can slide axially, motors that make the rotating means of the first and second pairs rotate around their respective axes at a controlled speed during bar feed, means for controlling the speed of the rotating means to keep the rotating means turning at the second feeding speed and actuator means comprising a pneumatic cylinder of the push type for bringing the rotating means of the second pair closer to the first pair, so that the bar can be gripped between the rotating means during the movement to generate friction between the rotating means and the bars, and a hydraulic cylinder of the pull type for moving the rotating means of the second pair away from the first pair.

2. Device according to claim 1, wherein said rotating means consist of rollers.

3. Device according to claim 1, wherein said pairs of rotating means transmit motion to a tracked belt wrapped around the respective rotating means and between the rotating means and the bar.

4. Device according to claim 1, further comprising means for adjusting the position of the first pair of rotating means in relation to the axis (X).

5. Device according to claim 1, wherein the actuator means are coupled to each rotating means of the second pair.

6. Method for changing the speed of bars, having a first feeding speed upon leaving a rolling train, by means of a bar speed changing device comprising the following steps:

a) a rotating means of a first and second pair are made to rotate by means of motors, at a speed that is equal to a second bar feeding speed, b) the bar is inserted into a passage defined between first and second pairs of rotating means, c) actuator means, comprising a pneumatic cylinder of the push type and a hydraulic cylinder of the pull type, are activated so as to bring first and second pairs of rotating means closer in order to clamp the bar until friction is created between rotating means and bar, d) a power generated by the motors is controlled so that the rotating means keep turning at the second feeding speed.

7. Method according to claim 6, wherein first and second pairs of rotating means move away from one another once the bar has passed.

8. Method according to claim 6 wherein said second speed is lower than the first feeding speed.

9. Method according to claim 6 wherein said second speed is higher than the first feeding speed.

10. Method according to claim 6 wherein the rotating means of the first pair is stationary while the rotating means of the second pair is traversed closer to the rotating means of the first pair.

11. Method according to claim 1 wherein the rotating means of the first pair is stationary while the rotating means of the second pair is traversed closer to or away from the rotating means of the first pair.

* * * * *